United States Patent [19]

Huggins

[11] Patent Number: 4,761,008

[45] Date of Patent: Aug. 2, 1988

[54] HOLDERS FOR BINGO SUPPLIES

[75] Inventor: Peter D. Huggins, Ashtabula, Ohio

[73] Assignee: Iten Industries, Ashtabula, Ohio

[21] Appl. No.: 82,299

[22] Filed: Aug. 6, 1987

[51] Int. Cl.[4] ..... A63F 9/00

[52] U.S. Cl. ..... 273/148 R; 206/45.18; 206/45.2; 206/315.1; 220/22

[58] Field of Search ..... 273/148 R, 148 A; 206/45.18, 45.2, 214, 315.1; 220/22

[56] References Cited

U.S. PATENT DOCUMENTS

| | | | |
|---|---|---|---|
| 4,209,085 | 6/1980 | Kozan | 206/315.1 X |
| 4,384,647 | 5/1983 | Schweiger | 206/214 X |
| 4,591,056 | 5/1986 | Groch | 206/214 X |
| 4,646,804 | 3/1987 | Damiano | 273/148 R X |

*Primary Examiner*—Anton O. Oechsle

*Attorney, Agent, or Firm*—J. Helen Slough

[57] ABSTRACT

A bingo game caddy useful for transporting and containing bingo player's paraphernalia comprises a compartmentalized container adapted to hold metal bingo tokens, magnetic dabbers, ink markers, coins, paper currency, and various personal items. The bingo caddy is particularly adapted to be carried horizontally and adapted to be supported on a playing surface table at an acute angle with the compartments therein adapted to face the user thereof, to provide clear vision into each compartment as well as easy access thereto during bingo playing. The bingo caddy can be sealed with a matching top to secure each compartment and provide a carrying case.

18 Claims, 6 Drawing Sheets

HOLDERS FOR BINGO SUPPLIES

BACKGROUND OF THE INVENTION

The invention pertains to a bingo game caddy and particularly to a combined carrying case and equipment supply container used by bingo players.

Bingo equipment containers are known such as shown in the following U.S. Patents: U.S. Pat. No. 3,871,519 discloses two circular carrying cases adapted to carry bingo equipment inside; U.S. Des. No. 272,923 discloses an open equipment container having internal dividers; U.S. Des. No. 267,962 is directed to a combined game and carrying case; and U.S. Pat. No. 4,646,804 discloses a flexible handbag for carrying bingo equipment. Although the prior art bingo equipment containers provide adequate carrying cases, the containers are awkward to use as a bingo equipment supply container during a bingo game where quick and easy access is imperative to the bingo player.

It now has been found that a compartmentalized bingo caddy adapted to be both a secured carrying case and an easy access bingo equipment supply container in use during a bingo game. In use as a supply container, the compartmentalized container is supported by the exterior structure of the container at an acute angle with a horizontal table or other playing surface to provide a full and unobstructed view into each compartment without interference from the compartmentalized internal wall structure. The angular orientation of the compartmentalized container in use provides direct vision into the supply compartments while providing easy access to metal bingo tokens, magnetic dabbers, ink markers, coins, and paper currency as well as personal items such as cigarettes, cigarette lighter, matches, etc. often used while playing bingo. The top advantageously seals the compartmentalized container during transportation to avoid loss or commingling of the bingo paraphernalia while functioning as a travel case. These and other advantages of this invention will become more apparent by referring to the drawings and the detailed description of the invention.

SUMMARY OF THE INVENTION

Briefly, the invention is directed to a bingo caddy adapted to provide a secure carrying case during transportation and an easy access bingo equipment holder in use during a bingo game. The bingo caddy comprises a compartmentalized container having individual compartments adapted to hold bingo paraphernalia along with personal items. The compartmentalized container and closure top are particularly adapted to provide security to the contents during transportation. The exterior structural configuration of the compartmentalized container provides resting points on a playing table surface while tilting the container at an acute angle relative to the horizontal playing surface. The angular orientation of the compartmentalized container provides clear and unobstructed vision into the individual compartments while providing easy access in use.

IN THE DRAWINGS

DETAILED DESCRIPTION OF THE INVENTION

Figure 1:
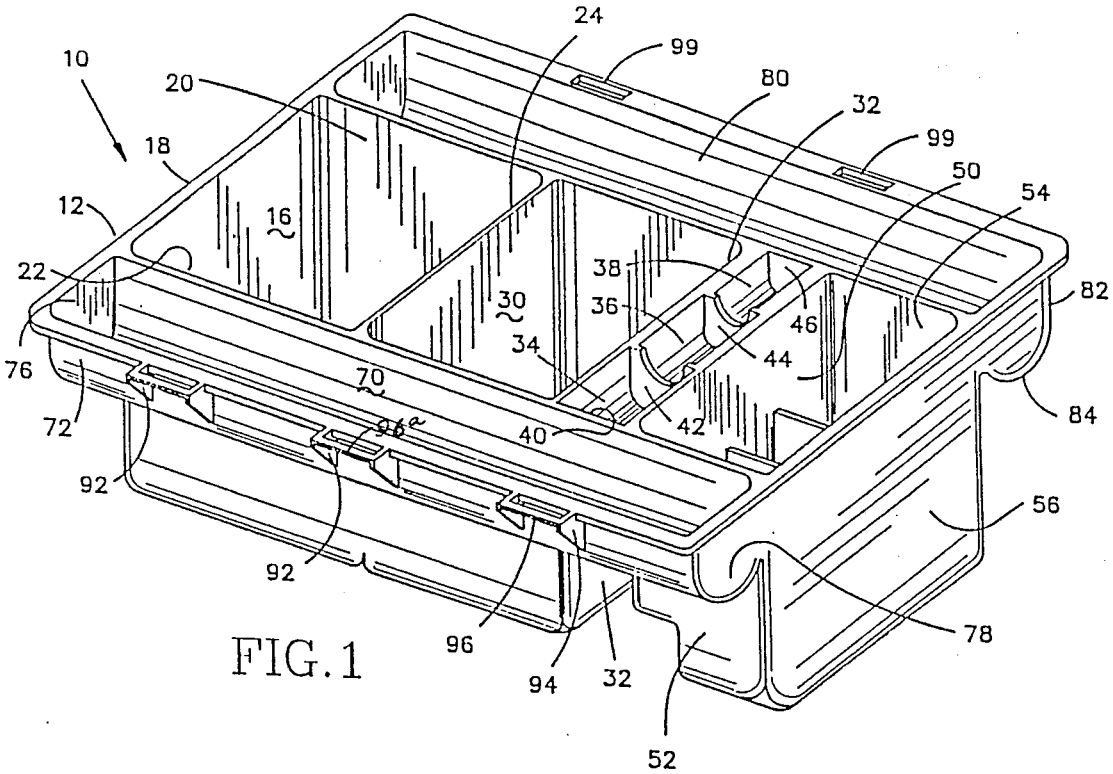
FIG. 1 is a perspective view of the compartmentalized container of the bingo caddy of this invention.

Referring now to the drawings wherein like reference characters designate like parts, shown is a bingo game caddy 10 comprising a compartmentalized container 12 and a detachable top 14.

Figure 3:
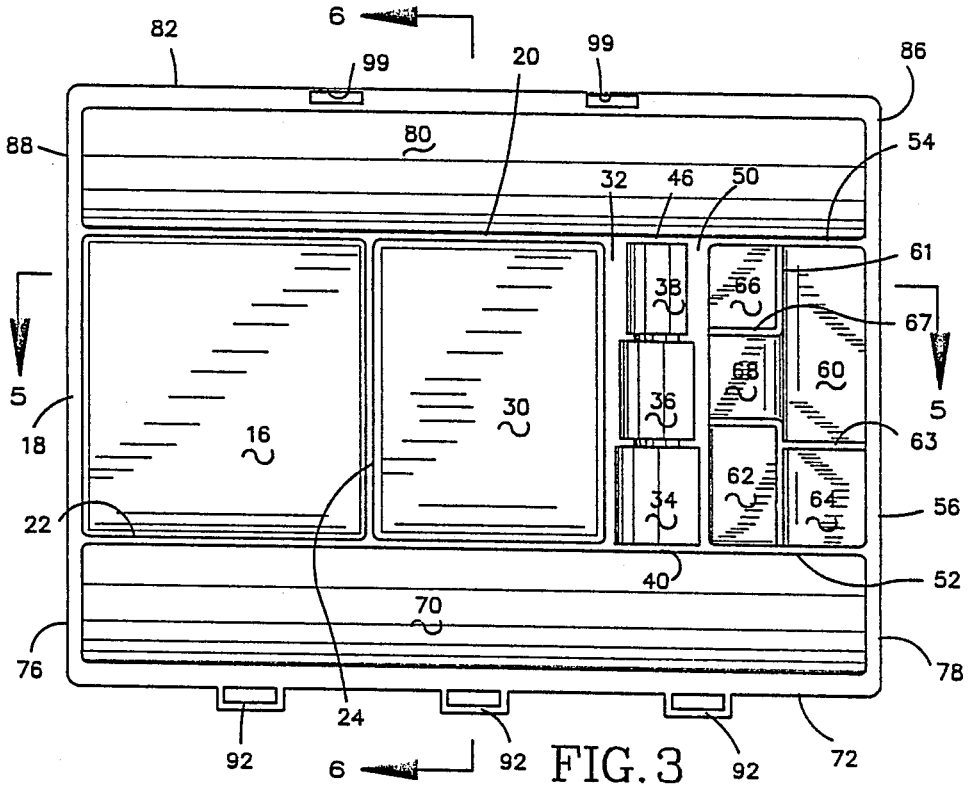
FIG. 3 is a top plan view of the compartmentalized container in FIG. 1.
Figure 4:
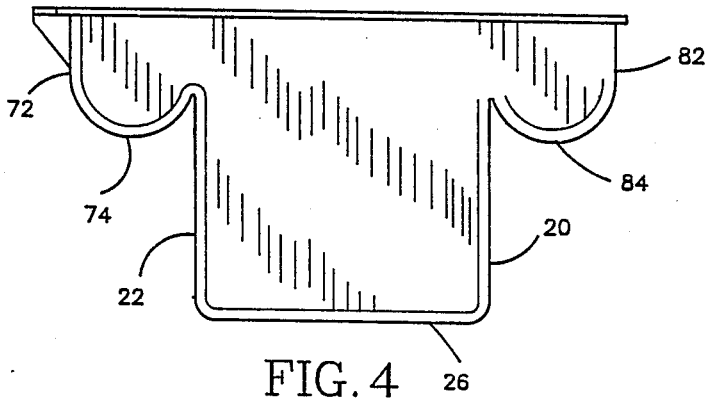
FIG. 4 is a side elevation view of the compartmentalized container in FIG. 1.

The compartmentalized container 12 comprises a plurality of individual compartments defined by container walls and useful for holding and maintaining separate various pieces of bingo paraphernalia such as metallic tokens, magnetic token dabbers, ink markers, coins and paper currency as well as personal items such as cigarettes, lighter or matches and the like. As best viewed in FIG. 1 and FIG. 3, the internal compartments are defined within a molded container 12 having interconnecting inside walls and outside walls defining the various compartments as hereinafter described. The molded container 12 further includes an upper peripheral flat lip 17 for peripheral sealing with the top 14 while the bingo caddy is closed and used as a traveling case.

Figure 5:
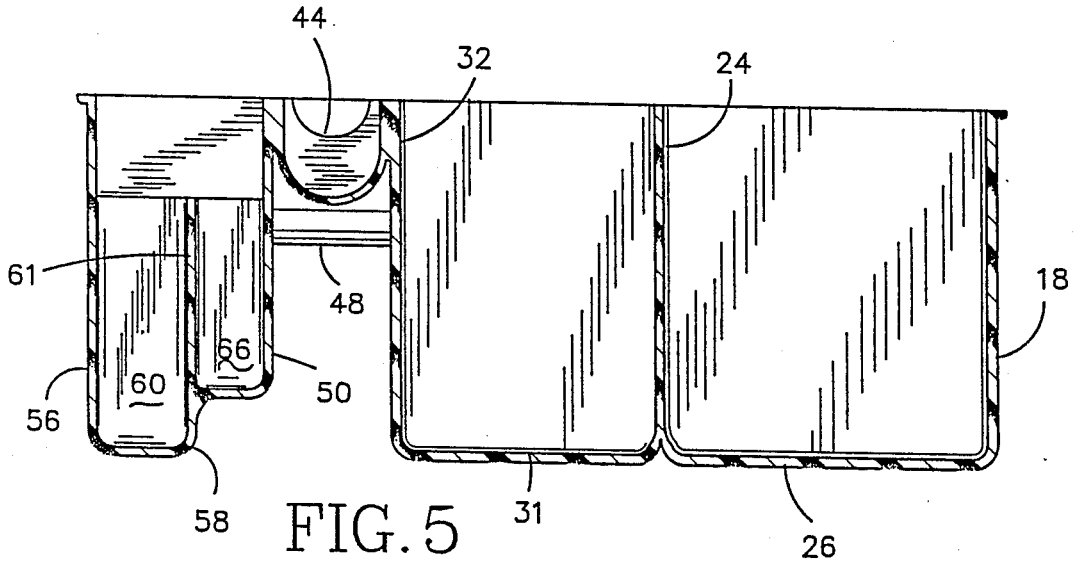
FIG. 5 is a sectional elevation view taken along lines 5—5 in FIG. 3.

Referring now in more detail to the various compartments, the molded container 12 includes at least one compartment 16 for holding metal bingo tokens and defined by an exterior side wall 18, a rearward wall 20, a forward wall 22, and an interior wall 24 along with a bottom 26. The metal tokens compartment 16 is a full depth compartment with vertical walls extending upwards to engage the undersurface of the top 14 when the bingo caddy 10 is closed. In a preferred aspect of the invention, a similar laterally adjacent full depth compartment 30 is defined by the common interior wall 24 and a laterally spaced parallel wall 32 in conjunction with the extending rearward wall 20 and extending forward wall 22. The compartment bottom can be formed by an extension of bottom 26 or can be an individual bottom 31 as shown in FIG. 5. The compartment 30 is particularly useful for holding a similar or different type of metallic token or other item used in a bingo game. Similar to compartment 16, compartment 30 is a full depth compartment with vertical walls engaging the undersurface of top 14 when the bingo caddy 10 is closed.

Located laterally adjacent to compartment 30 is a narrow width transversely disposed elongated compartment of shallow depth and comprising three smaller subcompartments 34, 36, and 38 for holding stacked coins and particularly for quarters, nickels, and dimes respectively. The elongated coin compartment is disposed between intermediate wall 32 and a laterally parallel wall 50. Each subcompartment 34, 36 and 38 comprises a half circle concave wall having a radius slightly larger than the radius of the respective coin held in the respective subcompartment. In particular, the quarter subcompartment 34 is defined by a concave wall 34, a forward short wall 40 and an intermediate notched wall 42. The nickel subcompartment 36 is defined by a concave wall 36 in conjunction with the common intermediate notched wall 42 and a second notched intermediate wall 44. The dime subcompartment 38 is defined by a concave wall 38, the second notched wall 44, and a rearward short wall 46. As viewed in FIG. 5, the exterior structure of the elongated coin compartment is preferably a flat wall configuration 48 to provide structural strength and integrity to the concave surfaces of the respective semi-circular subcompartments 34, 36, and 38.

The bingo caddy 10 further contains a personal items compartment disposed laterally adjacent to the elongated coins compartment. The personal items compartment is defined by an intermediate half-wall 50, a forward irregular wall 52, a rearward irregular wall 54, a full depth side wall 56, and an irregular stepped bottom 58, as best shown in sectional view FIG. 5. The personal items compartment comprises a plurality of variable depth subcompartments 62, 68, and 66 along with full depth subcompartments 60 and 64 as best viewed in FIG. 3. The subcompartments preferably are square or rectangular in horizontal cross-section and can include a cigarette subcompartment 60, a lighter subcompartment 62, a paper currency subcompartment 66, and miscellaneous subcompartments 64 and 68. The full depth subcompartment 64, for instance, can be used for pencils. The personal items compartment is divided into subcompartments 60, 62, 64, 66 and 68 by a common divider wall 61 in a parallel spaced relationship between half-wall 50 and side wall 56 further interconnected with laterally directed small divider walls 63, 65 and 67 as best viewed in FIG. 3. The divider walls 61, 63, 65 and 67 are shorter walls and need not be full height as shown in FIG. 5.

Figure 6:
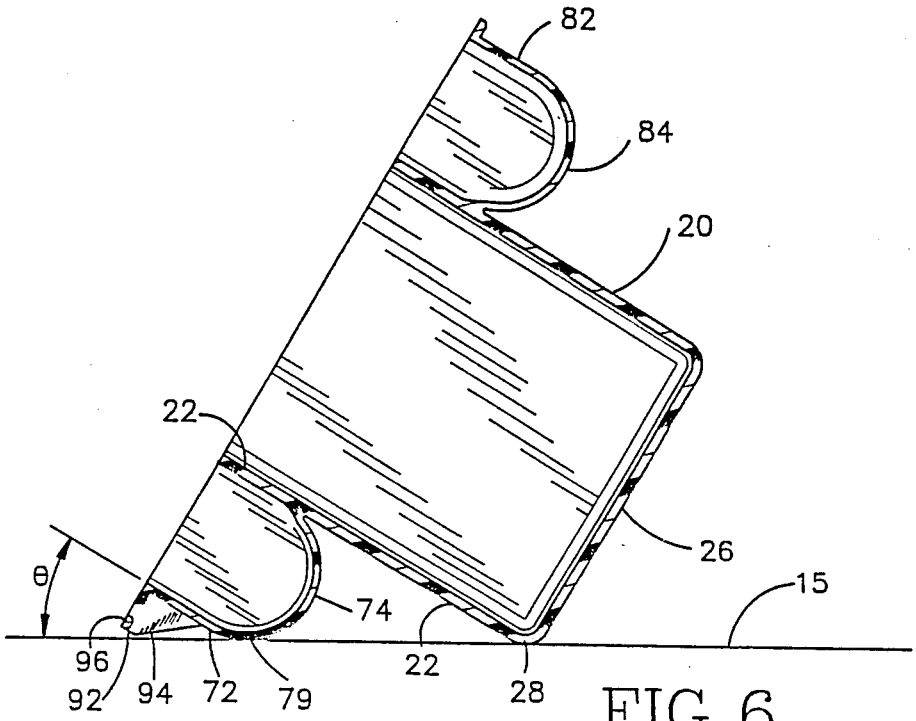
FIG. 6 is a side elevation sectional view taken along lines 6—6 in FIG. 3 but rotated to rest on a horizontal playing surface forming an acute angle with the playing surface.

The bingo caddy 10 further contains a forward U-shaped, shallow depth elongated compartment 70 stretched laterally across the front of the compartmentalized container 12 and a rearward U-shaped shallow depth elongated compartment 80 stretched laterally across the rear of the compartmentalized container 12. The metal tokens compartment 16, compartment 30, coins compartment, and personal items compartment are interposed between the forward and rearward U-shaped compartments 70, and 80 respectively. Forward U-shaped compartment 70 is useful for holding one or more ink bingo markers while rearward U-shaped compartment 80 is useful for storing a magnetic dabber, although the utilization of compartments 70 and 80 can be easily reversed if desired. A magnetic dabber is merely a stick with a magnet on one end for picking up magnetic bingo tokens. U-shaped forward compartment 70 is of shallow depth and defined by short depending front wall 72, a semi-circular bottom 74, a small portion of depending forward wall 22 and forward wall 52 as best viewed in sectional view FIG. 6. Compartment 70 is further enclosed by opposed distal end walls 76 and 78. In a similar manner, U-shaped elongated rearward compartment is of shallow depth and defined by a short depending rear wall 82, a semi-circular bottom 84, and a small portion of depending rearward walls 20 and 54, as best viewed in FIG. 6, and further enclosed by distal end walls 86 and 88.

In accordance with this invention, both the forward U-shaped compartment 70 and the rearward U-shaped compartment 80 are shallow in depth and particularly adapted with an exterior structure to provide a resting contact point with the playing surface 15 in conjunction with a contact point on the full depth compartments 16, 13 and full depth subcompartments 60 and 64. Sectional view 6—6 best illustrates forward U-shaped compartment 70 having a contact point 79 in contact with the playing surface 15 in conjunction with a right angle contact point 28 on full depth compartment 30 to support the bingo caddy 10 at an acute angle $\theta$ relative to the playing surface 15. Contact point 79 in conjunction with contact point 28 provides a very useful angular orientation of the compartmentalized container to enable unobstructed direct view into individual compartments as well as easy access thereto. As can be readily seen, the rearward U-shaped compartment 80 can be likewise utilized to prop the bingo caddy 10 at an angle $\theta$ relative to the playing surface 15. Angle $\theta$ should be between about 10° and 70° and preferably between about 30° and 50°.

Figure 2:
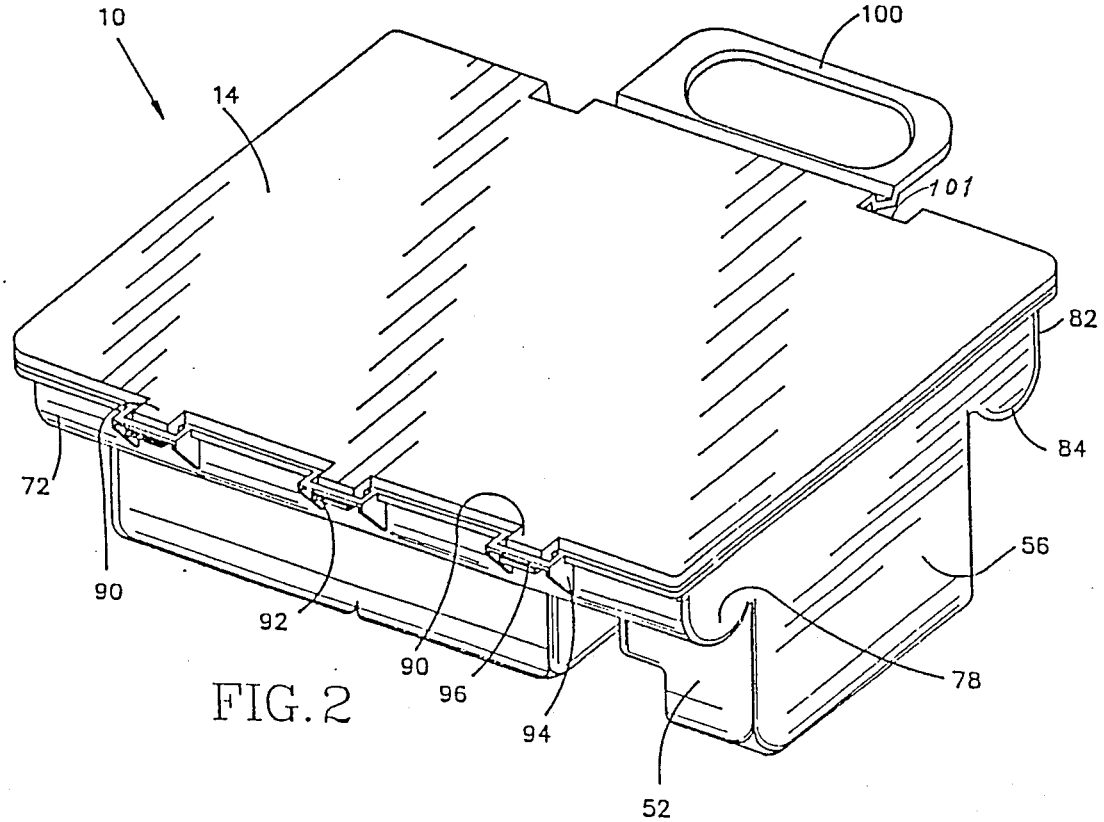
FIG. 2 is the compartmentalized container in FIG. 1 with the top attached.
Figure 7:
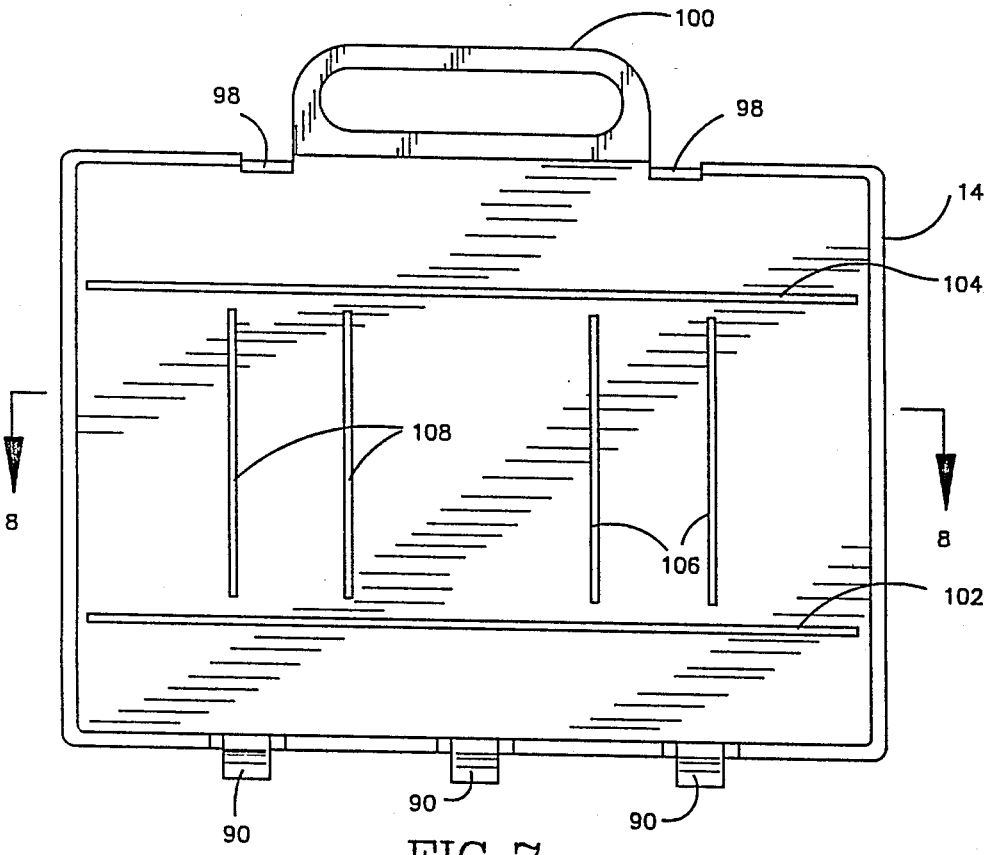
FIG. 7 is a bottom plan view of the interior surface of the top for the bingo caddy shown in FIG. 2.

Referring next to the top 14 of the bingo caddy 10, the top 14 is pivotally interconnected to the compartmentalized container 12 by a plurality of stepped connectors 90 attached to the top 14 and operatively engaging a like number of protruding hinged members 92 which are of a size adapted to be inserted through the openings **96*a* of the cross members 96 attached to the exterior surface of the depending front wall 72 of the forward U-shaped compartment 70. The members 92 may be as shown in FIGS. 2 and 7, flexible and curved to snap through the said openings 96*a*. More particularly, each connector 90 engages the respective hinge member 92 which comprises a pair of spaced side braces 94 with an interposed cross-member 96 providing sufficient space 96*a* therebetween to enable pivotal connection with the stepped connector 90, as best viewed in FIGS. 1 and 2**. The pivotal connection can be permanent or preferably detachable.

The top 14 further contains means for locking the top 14 in secure engagement with the compartmentalized container 12. The locking means can comprise a pair of depending clip members 98 adapted to mechanically interlock with openings 99 located in the rearward part of the upper peripheral edge 17 along the rearward wall 82 of the container 12. The top 14 further includes a carrying handle 100 which can be rigidly or flexibly attached to the rearward edge of the top 14. As shown in FIG. 2, it is provided with a "living" hinge 101 which can bend for storage and facilitate shipping.

As best viewed in FIG. 7, the interior surface of the top 14 contains a pair of vertically spaced lateral ribs 102 and 104 adapted to engage and seal with forward walls 22 (and 40 and 52) and rearward walls 20 (and 46 and 54) respectively. The interior surface of top 14 further contains a pair of transverse raised ribs 106 and 108 laterally spaced and adapted to engage and seal with intermediate full height walls 32 and 24 respectively. Accordingly, the ribs 102, 104, 106 and 108 effectively seal the compartments and prevent loss or commingling of the bingo paraphernalia.

Figure 8:
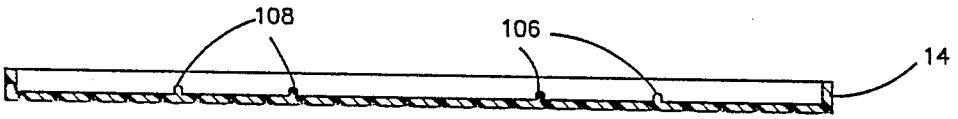
FIG. 8 is a sectional elevation taken along lines 8—8 in FIG. 7.
Figure 9:
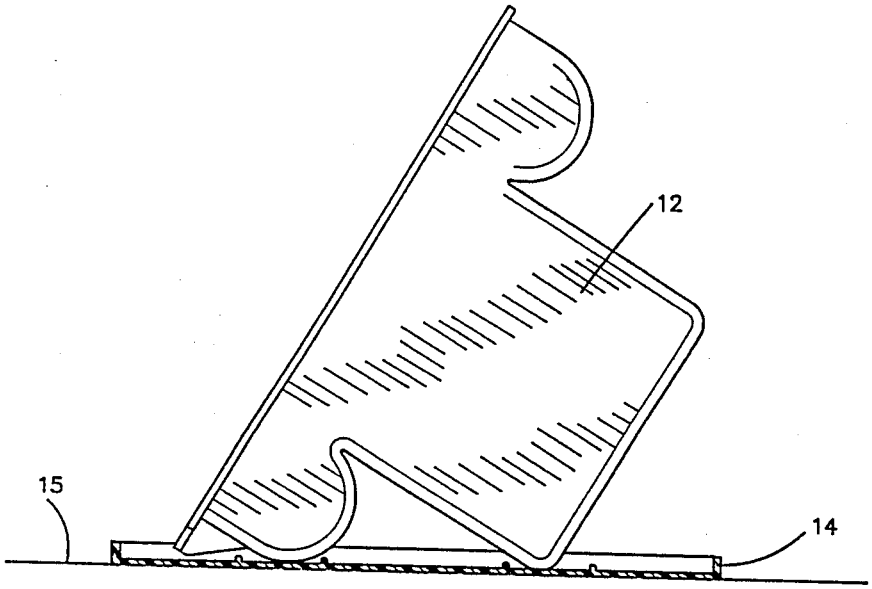
FIG. 9 is a view similar to FIG. 6 but showing the top used as a skid resistant surface beneath the compartmentalized container.
Figure 10:
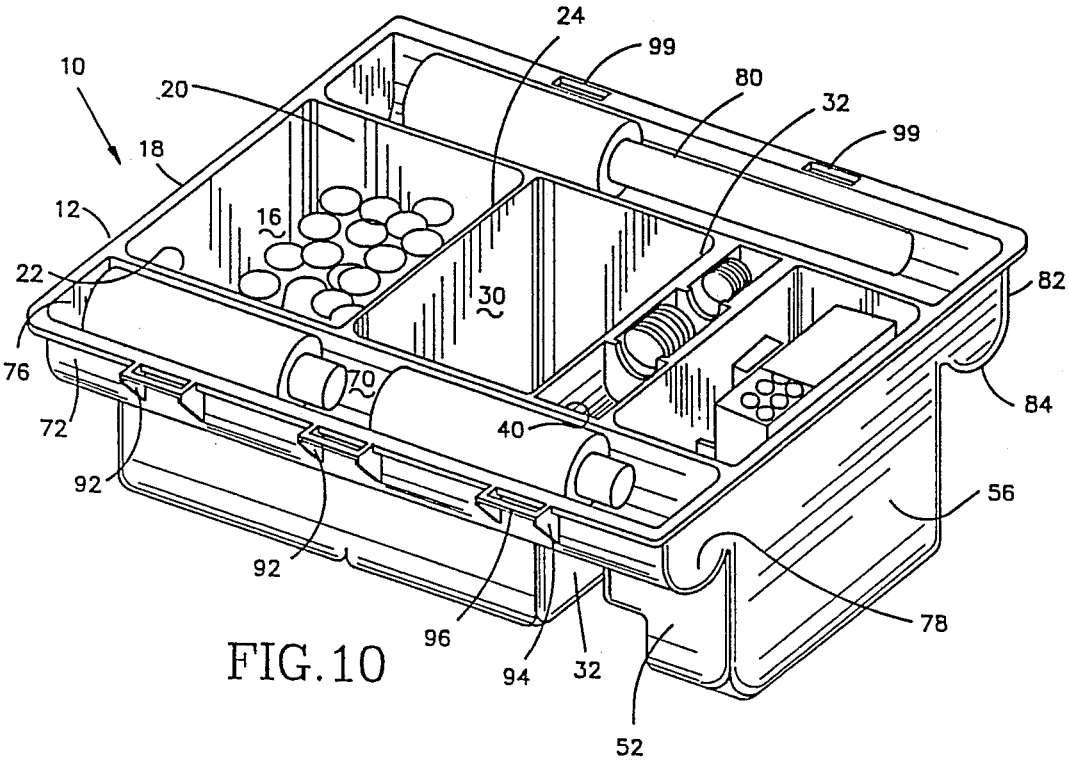
FIG. 10 is a perspective view of the bingo caddy in use containing bingo paraphernalia and personal items in the compartmentalized container.
Figure 11:
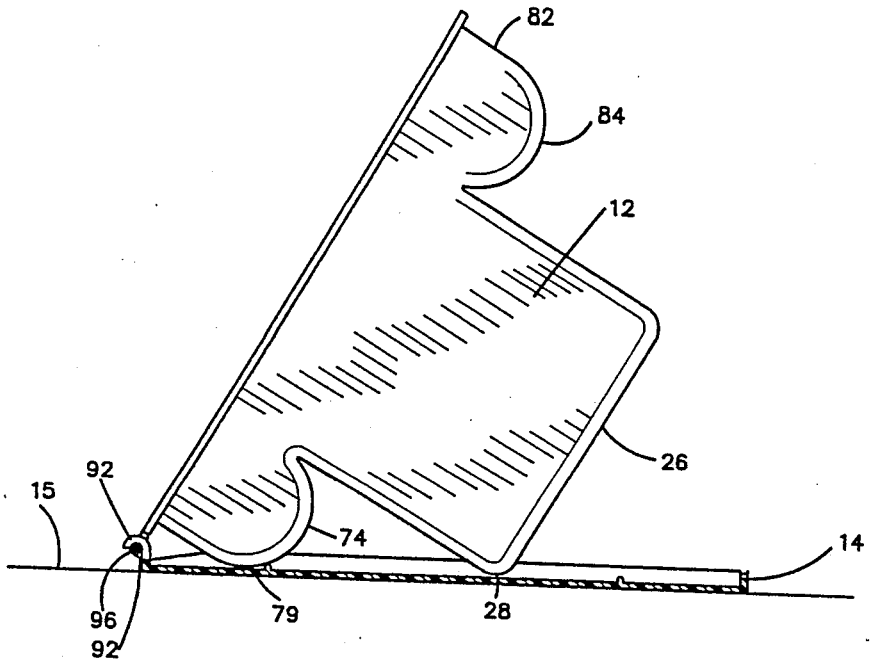
FIG. 11 is a view similar to FIG. 9 but showing the top secured to the container when in inverted position.

As best shown in FIGS. 2 and 8, the exterior surface is as shown smooth or it may comprise a textured surface particularly adapted to provide a non-skid surface. In this regard, the top 14 can be detached from the container 12 and placed exterior surface downward against the playing surface 15, as shown in FIG. 9 or FIG. 11. The compartmentalized container 12 is merely rested on the interior surface of the top as shown in FIG. 9, or the same may be secured to the top as shown in FIG. 11, the exterior surface if textured may provide non-skid features relative to the playing surface 15, as best viewed in FIG. 9. The top shown in FIG. 11, when desired, may be secured to the container by inverting and projecting the hinge means 90 through the openings 96a.

Both the top 14 and the compartmentalized container 12 can be formed from rigid or high density plastic materials such as polyethylene, polypropylene, or polyvinylchloride. The container 12 can be molded as a unitary molded part.

In use, the bingo caddy 10 can be utilized as a secure carrying case adapted to maintain the bingo paraphernalia within the various assigned compartments while traveling. Upon reaching the bingo game, the bingo caddy 10 can be simply opened and advantageously propped on the playing surface 15 or on the removed cover as shown in FIG. 9 and at an acute angle $\theta$ to provide a downward angular orientation and easy access to the bingo paraphernalia stored within the respective compartments. Propping the compartmentalized container at an angle $\theta$ advantageously provides a direct and unobstructed view of the inside of all compartments free of interference from obstructing the view due to various walls defining the respective compartments. Upon concluding the bingo game, the bingo caddy 10 can be simply closed and secured for transportation purposes and once again used as a carrying case.

The foregoing drawings and detailed description set forth preferred embodiments of the bingo caddy of this invention but are not intended to be limiting except as defined by the appended claims.

What I claim is:

1. A bingo caddy adapted to be a combined carrying case and a compartmentalized container for holding bingo paraphernalia while resting on a horizontal playing surface during use in a bingo game, the bingo caddy comprising:

a compartmentalized container and an interconnecting matching top having an interior surface adapted to seal said container when closed;

the compartmentalized container having a plurality of individual compartments defined by interconnecting wall members of said container, the individual compartments comprising an elongated, U-shaped, shallow forward compartment stretched laterally across the front of said container, an elongated U-shaped, shallow rearward compartment stretched laterally across the rear of said container, additional compartments interposed between the U-shaped compartments across respectively the front and rear container, certain of said additional compartments being of greater depth than the U-shaped compartments and provided with flat undersurfaces:

the compartmentalized container having an exterior configuration adapted to support the open compartmentalized container at an acute angle with the playing surface, the exterior configuration having an exterior forward contact point on one of the U-shaped elongated compartments and a rearward contact point on said large full depth compartment whereby the compartmentalized container is supported by the playing surface at an angle $\theta$ relative to the playing surface.

2. The bingo caddy in claim 1 where the exterior configuration contains an exterior forward resting point on the forward U-shaped compartment.

3. The bingo caddy in claim 1 where the exterior configuration contains an exterior forward resting point on the rearward U-shaped compartment.

4. The bingo caddy in claim 1 where the additional compartments include two large, full depth compartments interposed and secured between the rearward and forward U-shaped compartments respectively.

5. The bingo caddy in claim 1 having a personal items compartment which includes a subcompartment adapted to hold paper currency.

6. The bingo caddy in claim 1 having a personal items compartment which includes a subcompartment adapted to hold a cigarette pack.

7. The bingo caddy in claim 6 where the personal items compartment further includes a subcompartment adapted to hold a cigarette lighter.

8. The bingo caddy in claim 1 having a personal items compartment which comprises a plurality of variable depth subcompartments.

9. The bingo caddy in claim 1 where intermediate wall members separating said coin subcompartments are notched intermediate wall members.

10. The bingo daddy in claim 1 where the angle $\theta$ is between 10° and 70°.

11. The bingo caddy in claim 1 where the angle $\theta$ is between 30° and 50°.

12. The bingo caddy in claim 1 where the interior surface of the top contains raised ribs adapted to engage and seal with the interconnecting wall members upon closing of the bingo caddy.

13. The bingo caddy in claim 1 where the top is detachable from the compartmentalized container.

14. The bingo caddy in claim 13 where the top is detached, inverted, and provides support relative to the playing surface for the compartmentalized container.

15. The bingo caddy in claim 1 where the top contains locking means for locking engagement with the compartmentalized container.

16. The bingo caddy top, as claimed in claim 15, wherein the locking means carried by the top are adapted to lock the top on the container when in its inverted or top covering position.

17. The bingo caddy in claim 1 where the compartmentalized container comprises a unitary construction of molded plastic.

18. A bingo caddy adapted to be a combined carrying case and a compartmentalized container for holding bingo paraphernalia while resting on a horizontal playing surface during use in a bingo game, the bingo caddy comprising:

a compartmentalized container and an interconnecting matching top having an interior surface adapted to seal said container when closed;

the compartmentalized container having a plurality of individual compartments defined by interconnecting wall members of said container, the individual compartments comprising an elongated, U-shaped, shallow forward compartment stretched laterally across the front of said container, an elongated U-shaped, shallow rearward compartment stretched laterally across the rear of said container, at least one full depth compartment adapted to contain magnetic bingo tokens where said full depth compartment is disposed on one side of said container and interposed and secured between said forward and said rearward elongated, U-shaped compartments, a shallow transversely disposed elongated coins compartment interposed perpendicularly and secured between said forward and said rearward U-shaped compartments, wherein said coin compartment comprises three coin subcompartments adapted to receive and hold quarters, nickels, and dimes respectively, each said coin subcompartment defined by semi-circular concave walls having a radius approximately the radius of a quarter, nickel, and dime respectively, and said coin subcompartments separated by intermediate wall members, and a personal items compartment containing a plurality of variable depth subcompartments adapted to hold personal items, where the personal items compartment contains an outside full depth subcompartment of the same depth as the full depth compartment;

the compartmentalized container having an exterior configuration adapted to support the open compartmentalized container at an acute angle with the playing surface, the exterior configuration having an exterior forward contact point on one of the U-shaped elongated compartments and a rearward contact point on said large full depth compartment whereby the compartmentalized container is supported by the playing surface at an angle $\theta$ relative to the playing surface.

* * * * *